United States Patent [19]

Stoveken et al.

[11] 3,946,878

[45] Mar. 30, 1976

[54] MESSAGE HOLDER RACK

[75] Inventors: James N. Stoveken; Mary L. Glokner, both of Belle Mead, N.J.

[73] Assignee: Lawrence Peska Associates, Inc., New York, N.Y. ; a part interest

[22] Filed: Dec. 30, 1974

[21] Appl. No.: 537,203

[52] U.S. Cl. ..... 211/124; 211/89

[51] Int. Cl.[2] ..... A47H 13/00

[58] Field of Search ..... 211/45, 89, 123, 124, 120, 211/69.8, 119.01, 119.1, 119.11–119.13, 119.15, 113; 223/90, 91, 93, 96

[56] References Cited

UNITED STATES PATENTS

| | | | |
|---|---|---|---|
| 298,379 | 5/1884 | Heysinger | 211/69.8 |
| 561,634 | 6/1896 | Walsh et al. | 211/119.13 |
| 1,489,923 | 4/1924 | Budd | 211/119.1 X |
| 1,999,310 | 4/1935 | Thompson | 211/113 X |
| 2,473,047 | 6/1949 | Bershad | 211/119.01 X |
| 2,518,401 | 8/1950 | Thompson | 211/69.8 |
| 3,343,683 | 9/1967 | Wheeler | 211/124 X |
| D206,207 | 11/1966 | Stein | 223/91 X |

FOREIGN PATENTS OR APPLICATIONS

| | | | |
|---|---|---|---|
| 430,470 | 6/1935 | United Kingdom | 211/89 |
| 612,854 | 2/1935 | Germany | 211/89 |

*Primary Examiner*—Roy D. Frazier
*Assistant Examiner*—Terrell P. Lewis
*Attorney, Agent, or Firm*—Richard E. Nanfeldt

[57] ABSTRACT

A message holder rack is used to hold a plurality of written messages for a plurality of users. The rack comprises a bottom base with end upward extending columns, wherein a clip assembly cooperates between the upper portions of the columns. The clip assembly consists of a plurality of clothespin clips and cylindrical members arranged in an alternate sequence, wherein the clips are rotatably joined to the cylindrical members.

2 Claims, 4 Drawing Figures

MESSAGE HOLDER RACK

Our invention relates to a unique and novel rack for holding written messages.

A number of U.S. Pat. Nos. 1,178,237; 1,893,570; 2,116,386; and 3,343,683 have been employed as racks for holding various articles, but these aforementioned patents are non-applicable to our present invention.

An object of our present invention is to provide a rack for holding messages, wherein a plurality of persons can simultaneously use the rack.

A further object of our present invention is to provide a plurality of clip members for holding the messages, wherein the clip members are capable of being vertically rotated.

A still further object of our present invention is to provide a message holder rack of simple design and low manufacturing cost, wherein the rack is lightweight and portable.

Briefly, our present invention comprises a bottom base with end upward extending columns, wherein a clip assembly cooperates between the upper portions of the columns. The clip assembly consist of a plurality of clothespin clips and cylindrical members arranged in an alternate sequence, wherein the clips are rotatably joined to the cylindrical members.

BRIEF DESCRIPTION OF THE DRAWINGS

The objects and features of the invention may be understood with reference to the following detailed description of an illustrative embodiment of the invention, taken together with the accompanying drawings in which:

FIG. 5 illustrates a side cross sectional view of FIG. 4 along line 5—5.

DESCRIPTION OF THE PREFERRED EMBODIMENT

Figure 1:
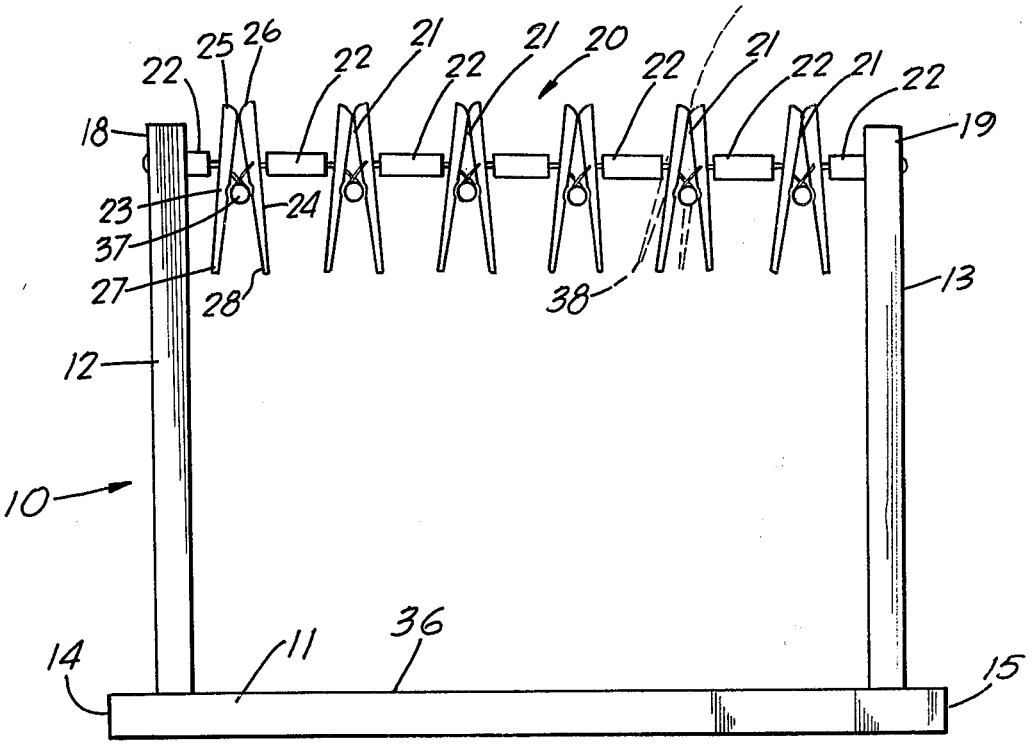
FIG. 1 illustrates a front view of the message holder rack.
Figure 2:
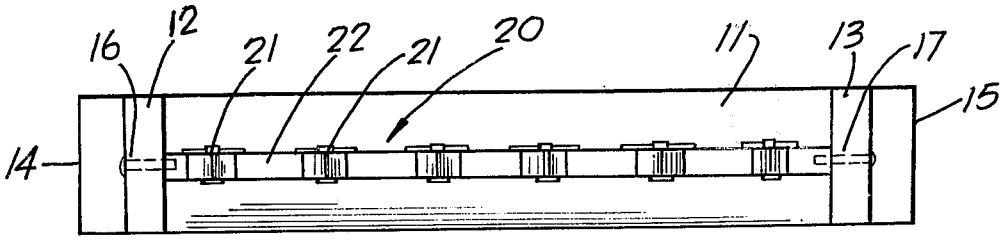
FIG. 2 illustrates a top cross sectional view of the message holder rack.

Turning now descriptively to the drawings, in which similar reference characters denote similar elements throughout the several views, FIGS. 1, 2 show a message holder rack 10 used to hold a plurality of pieces of paper. The rack 10 consist of an elongated rectangular base 11 having a pair of upward extending support columns 12, 13 affixed to the top face 36 at the outer ends 14, 15 of base 11. The upper portion 18, 19 of each column 12, 13 contains a transverse aperture 16, 17 therethrough, wherein aperture 16, 17 are aligned. A horizontally placed clip assembly 20 cooperates between the upper portions 18, 19 of the columns 12, 13. The clip assembly 20 comprises a plurality of conventional styled clothespin clips 21 and clyindrical members 22 arranged in an alternate sequence, wherein the clips 21 and members 22 are rotatably joined to each other in the alternate sequence, and two members 22 forms the outer ends of the assembly 20.

Figure 4:
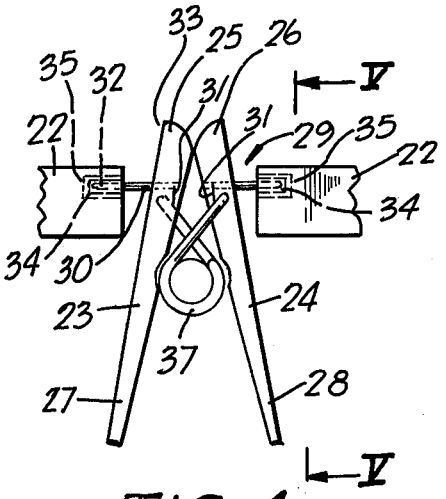
FIG. 4 illustrates a front view of a clothespin clip rotatably joined to two juxapositioned cylindrical members.

Each clip 21 as shown in FIGS. 4, 5 consist of a pair of duplicate companion parts 23, 24 with upper end providing jaws 25, 26, wherein the median portion of parts 23, 24 are joined together by a conventionally uniting spring assembly 26. The spring assembly 37 joins the parts 23, 24 together, wherein the lower finger grip ends 27, 28 are spread apart a normal divergent relationship. When the finger grip ends 27, 28 are squeezed together, the jaw ends 25, 26 are spread apart allowing the paper to be inserted within the jaw ends 25, 26. When pressure is released from the finger grip ends 27, 28 the jaw ends 25, 26 clamp together on the paper. An L shaped stout wire 29 has a longer 30 and a shorter 31 leg, wherein the shorter leg 31 and inner portion of the longer leg 30 is embedded into each jaw end 25, 26 of each clip 21. The free end 32 of each longer leg 30 protrudes laterally outward from the outside face 33 of each jaw grip 25, 26. A bearing assembly 34 is contained in a longitudinal opening 35, contained in each end of each cylindrical member 22. The free end 32 of each longer leg 30 is rotatably contained within each bearing assembly 34, wherein the longer leg 30 can move longitudinally back and forth within the bearing assembly 34 as the jaw ends 25, 26 of the clip 21 open and close.

The combination of each clip 21 and two joined L shaped wires 29 can freely rotate in a vertical plane as shown by phantom lines 38 of FIG. 1 with respect to the two juxapositioned cylindrical members 22 on either side of the clip 21. When a piece of paper is inserted between the jaw ends 25, 26 of the clip 21, the weight of the paper causes the jaw ends 25, 26 to vertically rotate downward 180° from their normal top position. The clips 21 can be formed from wood, metal or plastic in a plurality of colors, wherein a plurality of messages can be held for a plurality of persons assigned different colored clips 21.

Figure 3:
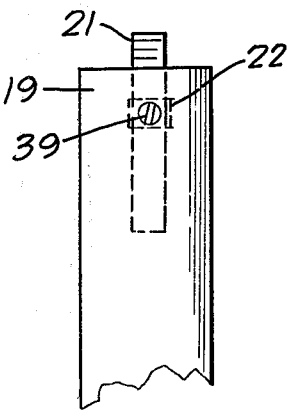
FIG. 3 illustrates an end sectional view of an upper end of a column of the message holder rack.

As shown in FIG. 3, each outer cylindrical member 22 is joined to the upper portion 18, 19 of columns 12, 13 by a screw member 39 passing through each aperture 16, 17 and threadly engaging each longitudinal opening 35 of each outer cylindrical member 22.

Hence, obvious changes may be made in the specific embodiment of the invention described herein, such modifications being within the spirit and scope of the invention claimed, it is indicated that all matter contained herein is intended as an illustrative and not as limiting in scope.

Having thus described the invention, what we claim as new and desire to secure by Letters Patent of the United States is:

1. A message holder rack adapted to hold a plurality of pieces of paper, which comprises:

a. an elongated base;

b. a pair of upwardly extending columns affixed to an upper surface at each end of said base, an upper portion of each said column having a transverse aperture therethrough;

c. a clip assembly consisting of conventional clothespin clips and cylindrically shaped members arranged in an alternate sequence, two said cylindrically shaped members forming the outerends of said clip assembly, said clothespin having two companion parts joined together at their median portions with a spring assembly, each said companion part having a finger grip end and a jaw grip end, each said cylindrically shaped member having a longitudinal opening in each end of said cylindrically shaped member;

d. a bearing assembly contained in each said longitudinal opening of said cylindrically shaped member;

e. a plurality of L-shaped wires, each said wire having a longer and a shorter leg, said shorter leg and an inner portion of said longer leg of each said wire embedded in said grip end of each said companion part, a free end of said longer leg of each said wire rotatably contained in one said bearing assembly in one said cylindrically shaped member, said longer leg having longitudinal freedom of movement back and forth within said bearing assembly as each said jaw grip end opens and closes; and f. a means for joining said clip assembly to said upwardly extending columns.

2. A rack as recited in claim 1, wherein said means for joining includes one screw member extending through each said aperture of each said column and threadably engaging into one said longitudinal opening of one said cylindrically shaped member.

* * * * *